US008347681B2

(12) United States Patent
Broussard

(10) Patent No.: US 8,347,681 B2
(45) Date of Patent: Jan. 8, 2013

(54) METHOD FOR ROLLING A SHEET METAL STRIP

(75) Inventor: Lionel Broussard, Orsay (FR)

(73) Assignee: Converteam Technology Ltd., Warwickshire (GB)

( * ) Notice: Subject to any disclaimer, the term of this patent is extended or adjusted under 35 U.S.C. 154(b) by 687 days.

(21) Appl. No.: 12/225,033

(22) PCT Filed: Mar. 14, 2007

(86) PCT No.: PCT/FR2007/000443
§ 371 (c)(1),
(2), (4) Date: Jan. 23, 2009

(87) PCT Pub. No.: WO2007/104865
PCT Pub. Date: Sep. 20, 2007

(65) Prior Publication Data

US 2009/0235706 A1 Sep. 24, 2009

(30) Foreign Application Priority Data

Mar. 14, 2006 (FR) ..... 06 02229

(51) Int. Cl.
*B21B 37/48* (2006.01)

(52) U.S. Cl. ..... 72/8.6; 72/10.3; 72/11.4; 72/205; 72/365.2; 700/149

(58) Field of Classification Search ..... 72/8.1, 72/8.6, 9.2, 10.1, 10.3, 10.4, 11.4, 11.5, 203, 72/205, 206, 365.2; 700/149
See application file for complete search history.

(56) References Cited

U.S. PATENT DOCUMENTS

| | | | | |
|---|---|---|---|---|
| 4,745,556 | A * | 5/1988 | Turley | 700/149 |
| 4,907,433 | A * | 3/1990 | Larson et al. | 72/10.3 |
| 5,012,660 | A * | 5/1991 | Peterson et al. | 72/10.4 |
| 6,185,967 | B1 * | 2/2001 | Imanari et al. | 72/8.6 |
| 6,240,756 | B1 * | 6/2001 | Tsugeno | 72/8.1 |
| 6,263,714 | B1 * | 7/2001 | Johnson et al. | 72/9.2 |
| 6,286,348 | B1 * | 9/2001 | Sekiguchi et al. | 72/9.2 |
| 6,463,777 | B1 * | 10/2002 | de Curraize et al. | 72/206 |
| 2007/0068210 | A1 * | 3/2007 | Pittner et al. | 72/10.1 |

FOREIGN PATENT DOCUMENTS

| | | |
|---|---|---|
| EP | 0 000 454 | 1/1979 |
| JP | 61 088911 | 5/1986 |
| JP | 4 059113 | 2/1992 |

* cited by examiner

*Primary Examiner* — David B Jones
(74) *Attorney, Agent, or Firm* — Davidson, Davidson & Kappel, LLC

(57) ABSTRACT

A method is provided for controlling cold rolling of a sheet metal strip involving continuously passing the strip in at least two successive rolling stands, each stand including at least two driven rolls between which the strip moves and is plated. The method includes estimating the slippage variation in output of one rolling stand; and correcting the rotation speed of the rolls of at least one corrected rolling stand based on the estimated slippage variation.

29 Claims, 4 Drawing Sheets

METHOD FOR ROLLING A SHEET METAL STRIP

The present invention relates to a method for cold rolling a sheet metal strip.

BACKGROUND

Cold rolling is an important stage in the production of long products in the metallurgy industry. Its objective is to reduce the thickness of the product input. The sheet metal products are usually destined for the motor vehicle and foodstuffs industries.

The rolling thus consists of reducing the thickness of a metal strip by means of plastic deformation. For this purpose, the strip circulates continuously between two rotating rolls, known as work rolls, with parallel axes, which delimit between one another a gripping space which is commonly known as an air gap, and to which force is applied. The reduction of thickness of the strip is then obtained by compression. This device constitutes a stand of a rolling mill. The use of a plurality of stands in succession into which the strip passes simultaneously constitutes a rolling mill tandem.

The work rolls are rotated at a regular speed. As it passes into the stands of the rolling mill, the speed of the strip increases, taking into account the decrease in its thickness and the maintaining its width.

For metallurgical reasons, the variations of thickness at the output from the tandem must be as slight as possible. For this purpose, different regulation loops are used.

Thus, it is common to continuously measure the linear speed of the strip output from the first stand, the thickness of the strip input into, and output from the first stand, and the thickness output from the final stand.

For example, it is known to correct the thickness by acting on the air gap of the work rolls of the first stand according to the thickness measured at the input of the first stand. The air gap is the distance which separates the two work rolls.

Similarly, it is known to modify the air gap of the work rolls of the first stand according to the thickness measured at the output from this first stand.

It is also known to modify the speed of rotation of the rolls of the first stand according to the thickness of the strip output from the first stand.

Finally, it is known to adjust the speed of rotation of the rolls of the final stand on the basis of the thickness measured at the output from this final stand.

These correction methods permit reduction of the variations of thickness of the strip, but remain insufficient to take into account complex phenomena which occur in a rolling mill.

In addition, in the particular context of hot rolling, a method is known from document EP-A1-0 000 454 for compensation for the effects of variation of slippage on the traction between stands, so as to maintain this traction at a constant value in order to maintain the width of the rolled product. This method is based on the principle of maintaining the speed of the strip at the two ends between stands.

Within the context of cold rolling, the physical phenomena involved are different. Thus, the traction between stands does not have any effect on the width of the rolled product. Consequently the problem of maintaining the traction between stands at a constant value solved by the method described in document EP-A1-0 000 454 is not important within the context of cold rolling. In addition, the matter of controlling the traction of the strip in a cold rolling installation is easily resolved by regulating traction using tractiometers. These devices are generally not used during hot rolling of a metal sheet, since they are very difficult to implement.

It is also usual, in cold rolling mills, to allow the traction between stands to increase naturally when the rolling speed decreases. Contrary to the hot rolling methods (where the traction is kept constant) it is this variation of traction between stands which gives rise to variation of slippage at the output from the stand upstream.

SUMMARY OF THE INVENTION

An object of the invention provides a cold rolling method which makes it possible to reduce further still the variations of thickness of the strip at the output from the rolling mill.

The invention provides a method for controlling the cold rolling of a sheet metal strip of the aforementioned type, characterised in that it comprises:

- estimating the variation of slippage at the output from a stand; and
- correcting the speed of rotation of the rolls of at least one stand, corrected in accordance with the estimated variation of slippage.

According to particular embodiments, the method may include one or more of the following features;

- the estimation of the variation of slippage comprises a step of measuring the linear speed of the strip at the output from the stand, a step of estimating the circumferential speed of the rolls in the stand, and a step of calculating the slippage of the strip on the basis of the linear speed of the strip at the output from the stand and the circumferential speed of the rolls of the stand;
- the variation of slippage is estimated for the first stand, taking into consideration the direction of circulation of the strip;
- the correction of speed is applied to a set of at least two successive stands, taking into consideration the direction of circulation of the strip;
- the corrections of speed applied to the successive stands are identical;
- the correction of speed comprises varying the speed of the stand which is corrected substantially when estimating the variation of slippage;
- the correction of speed comprises varying the speed of the first stand corrected with temporal offsetting which is equal to the time of transfer of the strip between the final corrected stand and the following stand, taking into consideration the direction of circulation of the strip;
- the temporal offsetting incorporates a delay caused by filtering; and
- the correction of speed comprises varying the speed of the first stand corrected with temporal offsetting which is equal to the time of transfer of the strip between the stand following the stand where the variation of slippage is estimated and the first corrected stand, taking into consideration the direction of circulation of the strip;
- gripping correction is applied to at least one stand adjacent to a corrected stand, in order to maintain the traction; and
- the control of a traction maintenance device situated upstream from the first stand and the said control takes into account the estimated variation of slippage.

The invention also provides a device for controlling the rolling of a sheet metal strip comprising at least two successive stands, each comprising at least two driven rolls between which the strip circulates and is compressed, characterised in that it comprises:

- means for estimating the variation of slippage at the output from a stand;

means for correcting the speed of rotation of the rolls of at least one stand corrected in accordance with the estimated variation of slippage; and means for implementing a method as previously defined.

BRIEF DESCRIPTION OF THE DRAWINGS

The invention will be better understood by reading the following description, provided purely by way of example and with reference to the drawings, in which.

DETAILED DESCRIPTION OF A PREFERRED EMBODIMENT

Figure 1:
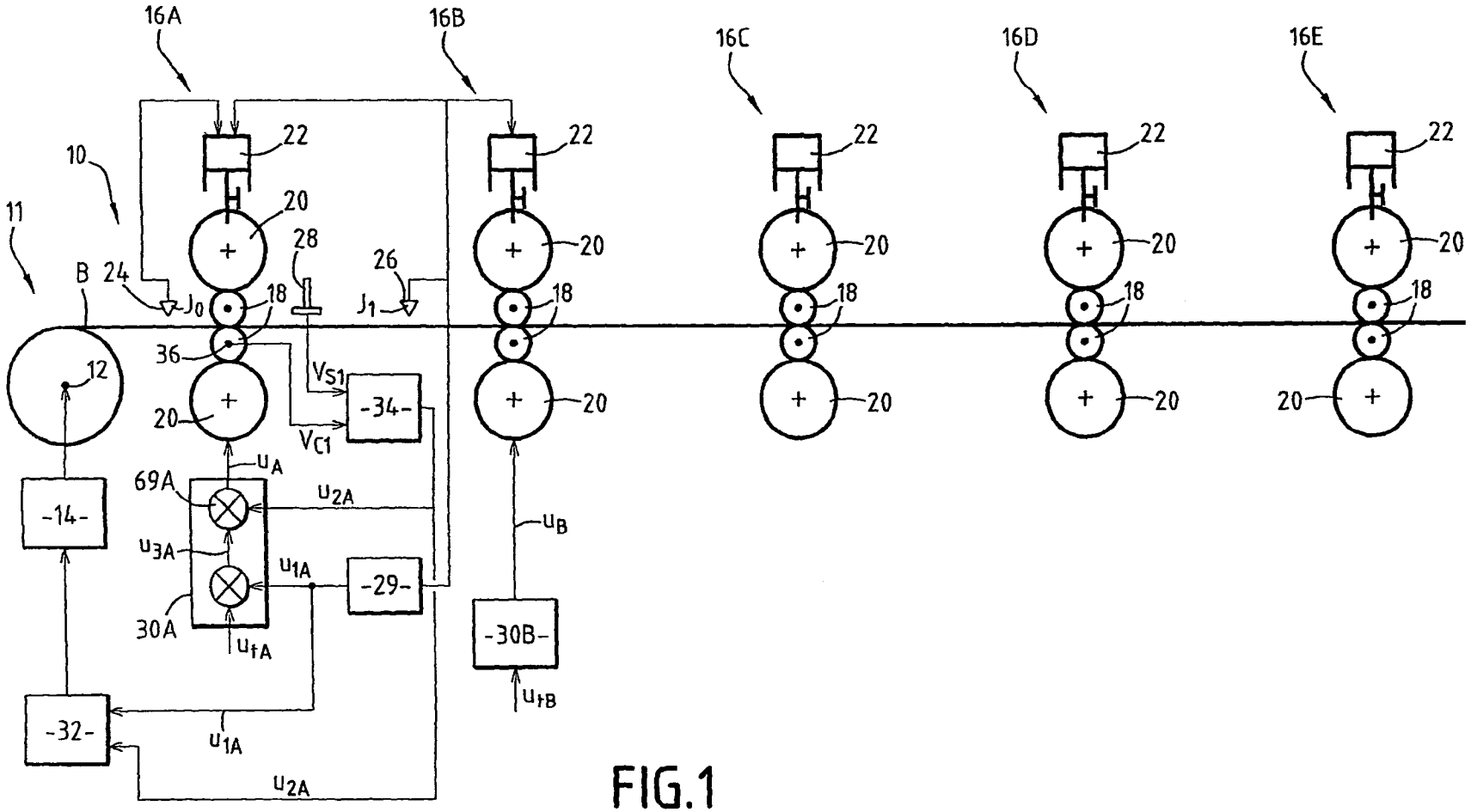
FIG. 1 is a schematic view of a rolling installation according to the invention.

FIG. 1 illustrates schematically an installation 10 for cold rolling of a metal sheet strip B. Thus, this installation comprises, in a known manner, a system 11 for maintaining the traction at the input of the rolling mill. This system comprises an uncoiler 12 in the case of a reel-to-reel rolling mill, or an S-shaped block in the case of a continuous rolling mill, the uncoiling speed of which is controlled by a unit 14 for controlling the moment.

The rolling installation to which this invention can be applied comprises between two and six stands. By way of example, a description will be given of an installation consisting of five stands 16A, 16B, 16C, 16D and 16E, through which the strip B circulates in succession.

In a known manner, each stand of the rolling mill comprises two work rolls 18 with parallel axes, between which the strip B circulates. These rolls are rotated by drive motors, the speed of which is regulated according to a predetermined command $U_A$, $U_B$ which is specific to each stand. Each stand comprises a hydraulic or electro-mechanical gripping device 22 which makes it possible to transmit to the two work rolls 18 the rolling force necessary in order for them to assure the predetermined reduction of thickness. This device 22 assures regulation of the air gap which separates the two rolls 18. The rolling force is transmitted from the device 22 to the work rolls 18 by means of stacking of one or more support rolls 20.

A gauge 24 for gauging the thickness $J_o$ is disposed upstream from the first stand 16A. This gauge 24 can continuously determine the thickness of the strip B before said strip enters the first stand 16A.

Similarly a second thickness gauge $J_1$ 26 is disposed at the output from the first stand 16A. It can determine continuously the thickness of the strip B after said strip has been rolled in the stand 16A.

In addition, a sensor 28 for sensing the speed $V_{S1}$ is disposed at the output from the first stand 16A. It can continuously determine the instantaneous linear circulation speed of the strip B at the output from the stand 16A. The sensor is formed, for example, by a laser velocimeter.

In a known manner, the gauge 26 is connected to a unit 29 for correcting speed according to the thickness measured at the output from the first stand 16A.

In a known manner, the motors for driving the rolls 18 of the first stand 16A and the second stand 16B are each controlled by a speed regulator 30A, 30B which can define a speed command for the associated stand motor. The speed regulator 30A is connected to the speed correction unit 29 in order to receive an approximate speed correction $u_{1A}$ which is used to calculate the command $u_A$ applied to the first stand 16A.

The speed regulator 30A receives at its input a theoretical speed $u_{tA}$.

The speed regulator 30B can receive at its input a theoretical speed $u_{tB}$ and at its output it can supply an approximate speed signal $u_B$ which is applied to the motor which drives the second stand 16B.

In a known manner, the thickness errors measured by the gauge 24 at the input of the stand 16A are compensated for by action on the air gap of the work rolls 18 of the stand 16A, by means of the gripping device 22. This action modifies the thickness at the output from the stand 16A.

In a known manner, the thickness errors measured by the gauge 26 at the output from the stand 16A are also corrected by action on the air gap of the work rolls 18 of the stand 16A, by means of the gripping device 22. This action modifies the thickness at the output from the stand 16A.

In a known manner, the thickness errors which are measured by the gauge 26 at the output from the stand 16A are corrected at the output from the second stand 16B by action on the speed of the first stand 16A. This speed correction is processed by the unit 29 and is applied to the stand 16A by the regulator 30A, which can regulate the speed of rotation of the work rolls 18 by modifying the speed reference $u_{tA}$ such that:

$$U_{3A}=(1+u_{1A})*ut_A.$$

The speed correction $u_{1A}$ which is associated with the first stand 16A is supplied to an inertia compensation unit 32, which itself is connected to the moment-controlling unit 14. On the basis of the speed correction $u_{1A}$ and the mechanical characteristics of the strip, the unit 32 can determine the moment which must be imposed on the system 12 for maintaining the traction at the input of the rolling mill.

According to the invention, the installation is provided with a unit 34 for compensation of the speed of rotation of the work rolls of at least two stands according to a variation of slippage measured at the output from the first stand of the rolling installation.

In the first embodiment illustrated in FIG. 1, the compensation unit 34 can modify the speed of rotation of the rolls only of the first stand 16A. The unit 34 is connected to the sensor 28 for measuring the speed $V_{s1}$. In addition, sensors 36 for measuring the speed of rotation of the drive motors of the rolls are provided on the first stand. This measurement makes it possible to calculate the circumferential speed $V_{c1}$ of the work rolls by means of the ratio:

$$V_{c1}=\pi*D_{t1}*N_{t1}$$

where:

$D_{t1}$ is the diameter of the work roll $N_{t1}$ is the measuring the speed of rotation of the work rolls.

The unit 34 is connected to these rotation speed sensors. The speed of the roll is different from the speed of the strip upstream and downstream from the roll, because of the variation of thickness of this strip during the passage between two rolls and the physical phenomena which are associated with the rolling. The speed of the strip is equal to the speed of the roll only at a point of the periphery of the roll designated by a neutral point.

Figure 2:
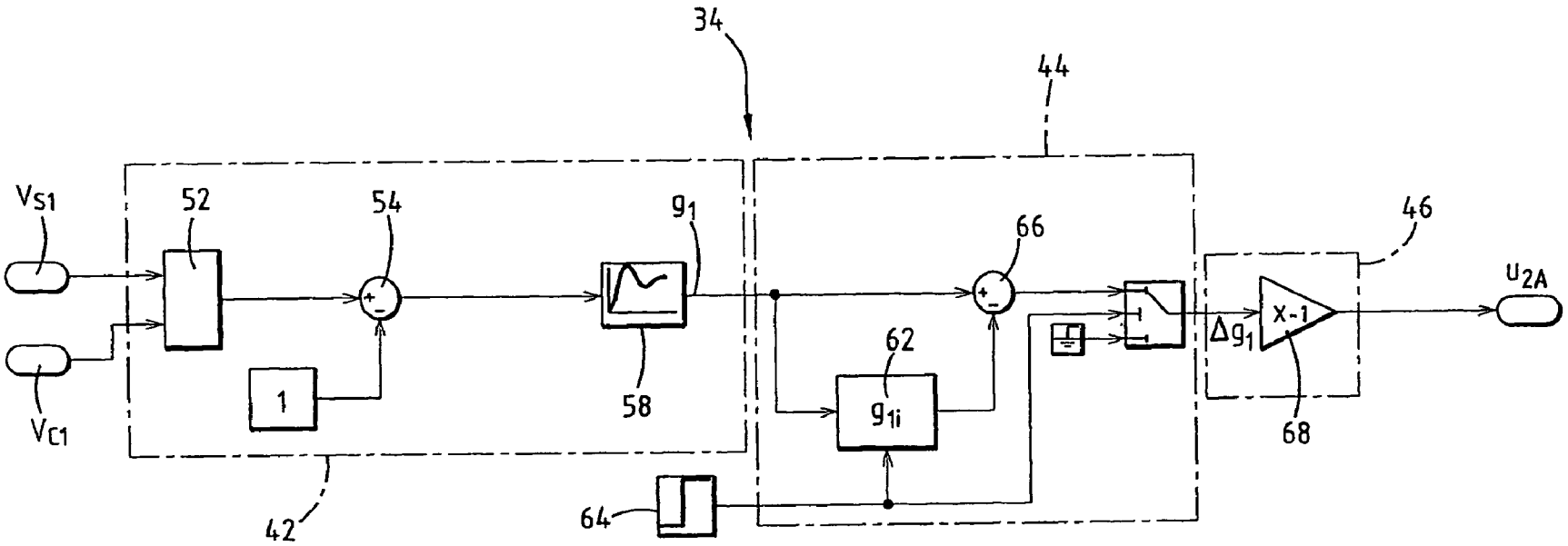
FIG. 2 is a diagram of the means for compensation for the effect of the variations of slippage on the thickness, explaining the correction steps to be implemented according to a first embodiment.

The diagram of the compensation unit 34 is illustrated in FIG. 2. This unit comprises a module 42 for calculating the slippage of the strip at the output from the stand 16A, a module 44 for calculating the temporal variation or variation over time of slippage of the strip, and a unit 46 for processing a signal for correcting the speed of rotation only of the rolls of the first stand 16A.

More specifically, the module for calculating the slippage 42 comprises a divider 52 which can assure the division of the linear speed $V_{s1}$ of the strip at the output from the first stand 16A by the circumferential speed $V_{c1}$ of the rolls of the first stand provided by the sensor 36.

A subtracter 54 subtracts the number 1 from the result of the quotient of the speeds.

Thus, the slippage $g_1$ is obtained by means of the equation:

$$g_1 = \left(\frac{V_{s1}}{V_{c1}} - 1\right)$$

where:

$V_{s1}$ is the linear speed of the strip between the first and second stands; and $V_{c1}$ is the circumferential speed of the rolls of the first stand.

The calculation module 42 comprises at its output a filter 58 which makes it possible to filter the measuring the slippage $g_1$.

The module 44 for calculating the temporal variation of slippage $\Delta_{g1}$ comprises a memory 62 which can store an initial filtered slippage value $g_{1i}$ produced by the module 42 when the unit 34 is started up. Thus, a triggering device 64 can assure storing the current slippage value produced by the module 42 when the unit is started up.

The module 44 additionally comprises a subtracter 66 which can calculate the difference between the current filtered slippage $g_1$ obtained at the output from the module 42 and the initial filtered slippage value $g_{1i}$ stored in the memory 62. A slippage variation $\Delta_{g1}=g_1-g_{1i}$ in the stand 16A is thus obtained.

In this embodiment, the unit 46 can assure the regulation of the relative correcting speed of the unit 34. In theory this gain is −1.

An additional correction signal $u_{2A}=-1*\Delta_{g1}$ is thus obtained at the output from the module 46.

As illustrated in FIG. 1, the output of the unit 46 is connected to a multiplier 69A which is provided at the output of the speed regulator 30A. The output of the multiplier supplies the speed command value $u_A$ to the drive motor of the rolls 18. The multiplier can multiply the command value $u_{3A}$ by $(1+u_{2A})$. Thus, the percentage of the speed command $u_{1A}$ is increased or decreased by a quantity equal to the opposite of the variation of slippage $\Delta_{g1}$ at the point of measurement concerned.

It has been found that an installation of this type makes it possible to assure improved regularity of the thickness of the strip at the output of the rolling installation. In fact, the additional correction $u_{2A}$ which is provided by the unit 34 makes it possible to take into account in the running of the installation variations of slippage which occur in particular in the first stand, by acting directly on this stand.

The additional correction carried out by the unit 34 is satisfactory since it is possible to prove that the variation of slippage in a stand is equal to the relative variation of thickness in the following stand, i.e.:

$$\frac{\Delta E_2}{E_2} = \Delta g_1$$

where:

$\Delta E_2$ is the variation of thickness at the output from the stand 16B;

$E_2$ is the reference thickness at the output from the stand 16B;

$\Delta g_1$ is the variation of slippage at the output from the stand.

Figure 3:
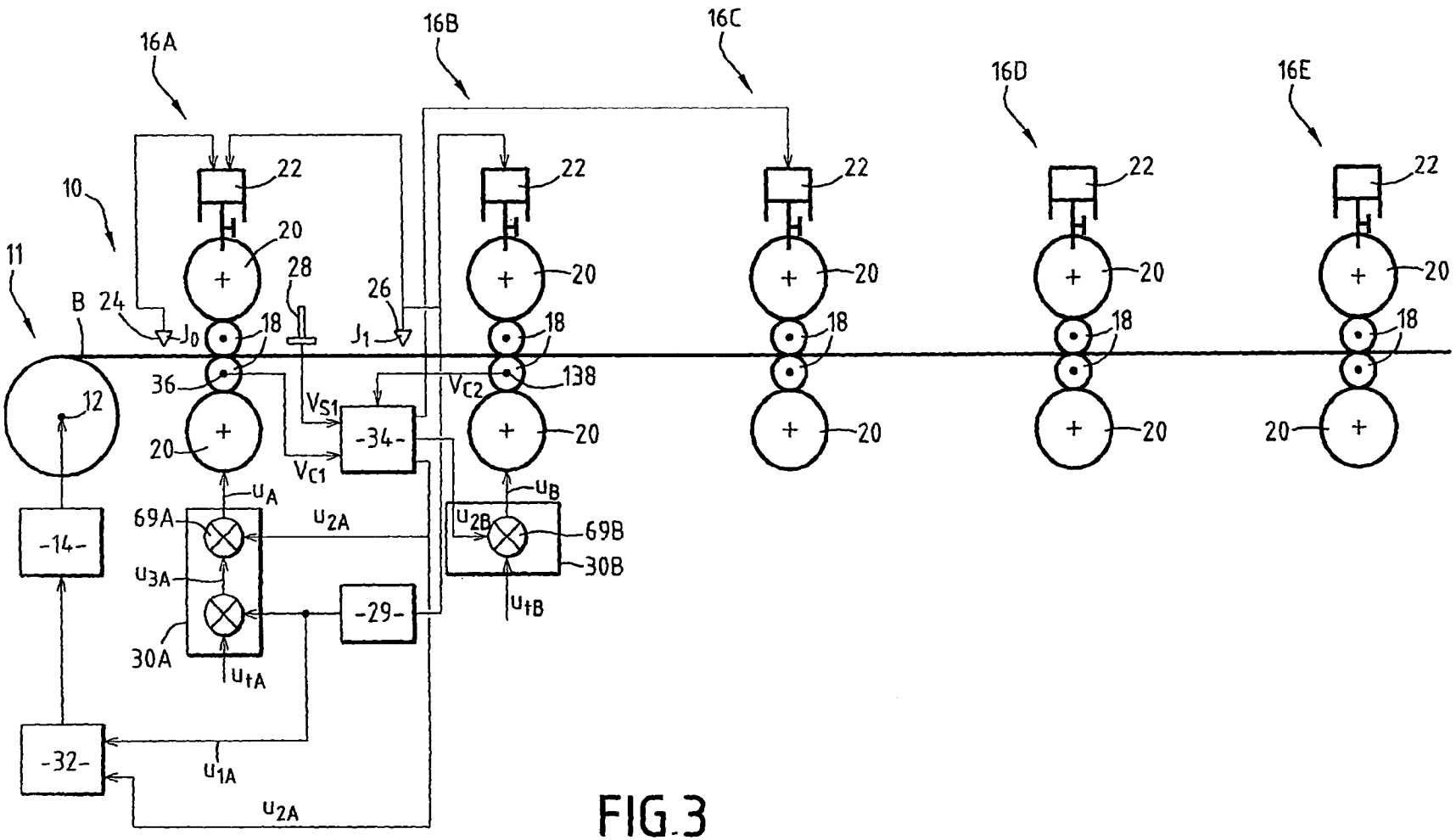
FIGS. 3 and 4 are views identical to those in FIGS. 1 and 2 respectively, of another embodiment.

FIG. 3 illustrates another embodiment of a rolling installation. This includes elements which are identical or correspond to those in FIG. 1. These are designated by the same reference numbers.

This installation additionally comprises a sensor 138 for measuring the speed $V_{c2}$ of rotation of the drive motors of the stand 16B, thus making it possible to measure the instantaneous circumferential speed of the work rolls of the second stand 16B. This sensor is connected to the additional compensation unit 34.

In this embodiment, the unit 34 comprises two outputs, one which is connected to the multiplier 69A and a second one which is connected to a second multiplier 69B which is integrated into the speed regulator 30B.

The second output of the additional compensation unit 34 can provide an additional correction $u_{2B}$ sent to the multiplier 69B in order to provide at the output thereof a speed command value $u_B$ which is applied to the motor of the second stand 16B.

The command $u_B$ is equal to the approximate command $u_{tB}$ corrected by the additional correction $u_{2B}$ according to the ratio $u_B=u_{tB}(1+u_{2B})$.

In addition, the additional compensation unit 34 comprises an output $u_{2c}$ for controlling the gripping position of the rolls of the third stand 16C.

Figure 4:
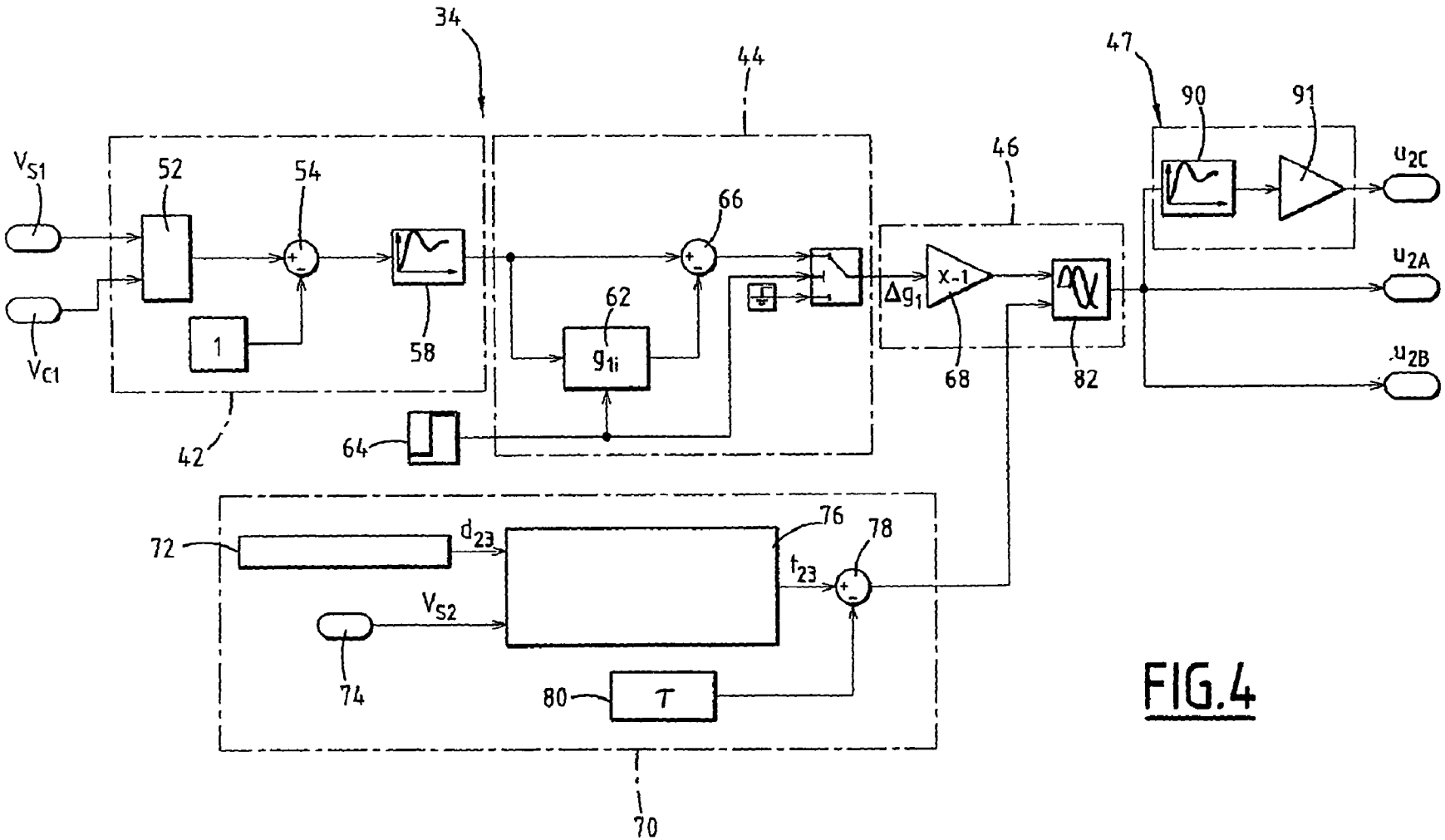

The diagram of the additional correction unit 34 is illustrated in FIG. 4. This diagram contains once again the modules 42 and 44 of the first embodiment.

In addition, the unit 34 comprises a module 70 for estimating the transfer time of the product between the second and third stands 16B, 16C. This module comprises a memory 72 for storing the distance $d_{23}$ which separates the second and third stands 16B and 16C, as well as an estimator 74 for estimating the linear speed $V_{S2}$ of the strip between the second and third stands 16B, 16C. This estimator 74 can determine by calculation the speed of the strip at the output from the second stand 16B, in particular on the basis of the ratio:

$$V_{s2}=V_{c2}(1+g_{S2Th})$$

where:

$V_{s2}$ is the linear speed of the strip between the second and third stands; and $V_{c2}$ is the circumferential speed of the work rolls of the second stand obtained from the sensor 138;

$g_{S2Th}$ is the theoretical slippage at the output from the second stand.

The module 70 comprises a divider 76 which can calculate the time $t_{23}$ of transfer of a point of the strip B between the second and third stands, from the distance $d_{23}$ which separates these stands and the speed $V_{S2}$ of circulation of the strip.

At the output from the divider 76 there is provided an adder 78 which is connected to a memory 80 for storing a delay constant $\tau$ corresponding to the time of propagation of the slippage filter 58.

The output of the module 70 is connected to a delay line 82 which is integrated into the correction module 46. This delay line receives at the input the signal $-\Delta g_1$ obtained at the output from the multiplier 68.

The delay line 82 can assure application of an additional correction signal $u_{2A}$, $u_{2B}$ to the stands 16A and 16B with the delay produced by the module 70.

The output from the delay line 82 is applied to the two multipliers 69A, 69B such that the speed commands $u_A$, $u_B$ are each corrected relatively as a percentage of a quantity equal to:

$$\Delta g_1(t+t_{23}-\tau)$$

where:

t is the measurement instant;

$t_{23}$ is the time of transfer between the stands 16A and 16B; and $\tau$ is the propagation time of the slippage filter 58.

The role of the module 47 is to assure maintaining the traction between the stands 16B and 16C by calculating correcting gripping $u_{2c}$ for the stand 16C on the basis of the speed correction $u_{2B}$. In fact, the speed correction $u_{2B}$ on the one hand and the variation of thickness at the input of the stand 16C generated by the variation of slippage $\Delta g_1$ on the other hand give rise to these variations of traction. The output from the module 82 is filtered by the module 90 in order to assure adaptation of the dynamics of the motor of the stand 16B relative to the gripping of the stand 16C. A gain $G_{91}$ is applied by a module 91 to the output signal of the module 90, in order to ensure that the variation of position of the gripping $u_{2c}$ of the stand 16C is just sufficient to compensate for the variation of traction induced by $u_{2B}$.

The gain of the module 91 is given by the ratio:

$$G_{91} = \frac{\frac{\partial F_3}{\partial E_e}}{Cg_3} E_{e3}$$

where:

$$-\frac{\partial F_3}{\partial E_e}$$

is the variation of effort of the stand 16C relative to the variation of thickness at the input of this stand; and $Cg_3$ is the yielding of the stand 16C; and $E_{e3}$ is the thickness at the input of the stand 16C.

In the example illustrated in relation to FIGS. 3 and 4, the first and second stands have their roll rotation speed corrected in order to take into account variations of slippage $\Delta g_1$ at the output from the first stand, so that the variation of thickness which may have taken place at the output from the second stand relative to a theoretical optimum thickness is compensated for during the passage of the strip into the third stand 16C.

More generally, the method according to the invention can be extended to more than two successive stands, the speed of the rolls of all the stands or only of a partial number of stands, with the exception of the final one, being able to be corrected by the same relative amount, and taking into account the transfer time of the product between the second stand and the final corrected stand, so that the final corrected stand assures compensation for the variation of thickness generated by the variations of slippage at the output from the first stand.

Advantageously, and as illustrated in FIGS. 1 and 3, the inertia compensation unit 32 additionally receives the speed correction $u_{1A}$ of the regulator 30A as is habitually known, and the additional speed correction $u_{2A}$ obtained by taking into account the correcting the unit 34, such that the variations of delivery at the input of the stand 16A can be compensated for by means of the system for maintaining the traction at the input of the rolling mill, with the purpose of not disrupting the traction at the input of the stand 16A.

In the embodiment illustrated, the units 30A, 30B and 34 are separate. However, as a variant, these units are put into operation functionally by a single computer.

In the embodiment previously described, the corrections of the speeds of the stands are applied starting from the first stand. However, in a dual manner, these stand speed corrections can be applied starting from the final stand. For example, for a rolling mill with five stands:

only a correcting relative speed equal to $+\Delta g_1(t+t_{23}+t_{34}+t_{45}-\tau)$ is applied to the final stand 16E; or correcting relative speed equal to $+\Delta g_1(t+t_{23}+t_{34}-\tau)$ is applied to the two final stands 16D and 16E; or correcting relative speed equal to $+\Delta g_1(t+t_{23}-\tau)$ is applied to the three final stands 16C, 16D, 16E.

In the preceding formulae, the following notations are used:

t is the instant of measurement;

$t_{23}$ is the transfer time between the stands 16B and 16C;

$t_{34}$ is the transfer time between the stands 16C and 16D;

$t_{45}$ is the transfer time between the stands 16D and 16E;

$\tau$ is the propagation time of the slippage filter 58.

In this embodiment, the inertia compensations are applied to the coiler device.

What is claimed is:

1. A method for controlling cold rolling of a sheet metal strip in a rolling installation, including continuous cold passage of the strip between at least two successive stands along a path, the at least two successive stands being a first stand and a second stand along a direction of the path, each stand including at least two driven rolls between which the strip passes and is compressed, the method comprising the steps of:

estimating a variation in the amount of slippage that occurs between the at least two driven rolls of the first stand and the sheet metal strip at an output from the first stand resulting from compression of the sheet metal strip by the at least two driven rolls; and correcting a speed of rotation of the at least two driven rolls of at least one corrected stand of the rolling installation, to compensate for the estimated variation in the amount of slippage.

2. The method according to claim 1 wherein estimating the variation of slippage includes measuring a linear speed of the strip at the output from the first stand, estimating a circumferential speed of the driven rolls in the first stand, and calculating a sliding of the strip based on the linear speed of the strip at the output from the first stand and the circumferential speed of the rolls of the first stand.

3. The method according to claim 1 wherein the variation of slippage is estimated for the first stand of the rolling installation, taking into consideration a direction of passage of the strip.

4. The method according to claim 1 wherein the step of correcting a speed is applied to a set of the at least two successive stands, taking into consideration a direction of passage of the strip.

5. The method according to claim 4 wherein corrections of speed applied to the at least two successive stands are identical.

6. The method according to claim 1 wherein correcting a speed includes varying the speed of the first stand which is corrected when estimating the variation of slippage.

7. The method according to claim 1 wherein correcting a speed includes varying a speed of the corrected stand with a transfer time offset, the transfer time offset being equal to a time of transfer of the strip between the corrected stand and a stand following the corrected stand, taking into consideration the direction of passage of the strip.

8. The method according to claim 7 wherein the transfer time offset includes a delay caused by filtering.

9. The method according to claim 1 wherein correcting a speed includes varying a speed of a first stand corrected with a transfer time offset, the transfer time offset being equal to the time of transfer of the strip between a stand following the first stand where the variation of slippage is estimated and the first corrected stand, taking into consideration the direction of passage of the strip.

10. The method according to claim 1 further comprising the step of applying a gripping correction to at least two driven rolls of at least one stand adjacent to a corrected stand, in order to maintain traction between the adjacent stand and sheet metal strip.

11. The method according to claim 1 further comprising the step of controlling a traction maintenance device for the sheet metal strip upstream from the at least one corrected stand, the controlling compensating for the estimated variation of slippage.

12. The method according to claim 1 wherein the first stand and the second stand are the first two consecutive stands along the path of the cold rolling installation.

13. A device for controlling cold rolling of a sheet metal strip in a rolling installation including at least two successive stands along a path, the at least two successive stands including a first stand and a second stand along a direction the path, each stand including at least two driven rolls between which the sheet metal strip passes in cold conditions and is compressed, the device comprising:

means for estimating a variation in the amount of slippage that occurs between the at least two driven rolls of the first stand and the sheet metal strip at an output from the first stand resulting from compression of the sheet metal strip by the at least two driven roll; and means for correcting a speed of rotation of the at least two driven rolls of at least one corrected stand of the rolling installation to compensate for the estimated variation in the amount of slippage.

14. A device for controlling cold rolling of a sheet metal strip in a rolling installation including at least two successive stands along a path, the two successive stands including a first stand and a second stand along a direction of the path, each stand including at least two driven rolls between which the sheet metal strip passes in cold conditions and is compressed, the device comprising:

an estimator for estimating a variation in the amount of slippage that occurs between the at least two driven rolls of the first stand and the sheet metal strip at an output from the first stand resulting from compression of the sheet metal strip by the at least two driven rolls; and a regulator for correcting a speed of rotation of the at least two driven rolls of at least one corrected stand of the rolling installation to compensate for the estimated variation in the amount of slippage.

15. The device for controlling cold rolling of a sheet metal strip as recited in claim 14 wherein a computer is used to implement the estimator and regulator.

16. A method for controlling a thickness of a cold-rolled sheet metal strip, including continuous cold passage of the strip in a rolling installation along a path, the rolling installation including at least two successive stands, the two successive stands including a first stand and a second stand along a direction of the path, each stand including at least two driven rolls between which the strip passes and is compressed, the method comprising the steps of:

estimating a variation in the amount of slippage that occurs between the at least two driven rolls of the first stand and the sheet metal strip at an output from the first stand resulting from compression of the sheet metal strip by the at least two driven rolls; and correcting a speed of rotation of the at least two driven rolls of at least one corrected stand to compensate for the estimated variation in the amount of slippage.

17. The method according to claim 16 wherein estimating the variation of slippage includes measuring a linear speed of the strip at the output from the first stand, estimating a circumferential speed of the driven rolls in the first stand, and calculating a slippage of the strip based on the linear speed of the strip at the output from the first stand and the circumferential speed of the rolls of the first stand.

18. The method according to claim 16 wherein the variation of slippage is estimated for the first stand of the rolling installation, taking into consideration a direction of passage of the strip.

19. The method according to claim 16 wherein the step of correcting a speed is applied to a set of the at least two successive corrected stands, taking into consideration a direction of passage of the strip.

20. The method according to claim 19 wherein corrections of speed applied to the at least two successive corrected stands are identical.

21. The method according to claim 16 wherein correcting a speed includes varying the speed of the first stand which is corrected when estimating a variation of slippage.

22. The method according to claim 16 wherein correcting a speed includes varying a speed of the corrected stand with a transfer time offset, the transfer time offset being equal to a time of transfer of the strip between the second corrected stand and a stand following the corrected stand, taking into consideration the direction of circulation of the strip.

23. The method according to claim 22 wherein the transfer time offset includes a delay caused by filtering.

24. The method according to claim 23 wherein correcting a speed includes varying a speed of a first corrected stand with a transfer time offset, the transfer time offset being equal to the time of transfer of the strip between a stand following the first stand where the variation of slippage is estimated and the first corrected stand, taking into consideration the direction of circulation of the strip.

25. The method according to claim 16 further comprising the step of applying a gripping correction to at least two driven rolls of at least one stand adjacent to a corrected stand, in order to maintain the traction between the adjacent stand and the sheet metal strip.

26. The method according to claim 16 further comprising the step of controlling a traction maintenance device for the sheet metal strip upstream from the at least one corrected stand, the controlling compensating for the estimated variation of slippage.

27. A device for controlling cold rolling of a sheet metal strip in a rolling installation including at least two successive stands along a path, the two successive stands including a first stand and a second stand taking into consideration a direction of passage of the strip, each stand including at least two driven rolls between which the sheet metal strip passes in cold conditions and is compressed, the device comprising:

means for estimating a variation of slippage that occurs between the at least two driven rolls of the first stand and the sheet metal strip at an output from the first stand resulting from compression of the sheet metal strip by the at least two driven rolls; and means for correcting a speed of rotation of the at least two driven rolls of at least one corrected stand to compensate for the estimated variation of slippage.

28. A device for controlling cold rolling of a sheet metal strip including at least a first stand and a second stand, each stand including at least two driven rolls between which the sheet metal strip passes in cold conditions and is compressed, the device comprising:

an estimator for estimating a variation in the amount of slippage that occurs between the at least two driven rolls of the first stand and the sheet metal strip at an output from the first stand resulting from compression of the sheet metal strip by the at least two driven rolls; and a regulator for correcting a speed of rotation of the at least two driven rolls of at least one corrected stand to compensate for the estimated variation of slippage.

29. The device for controlling cold rolling of a sheet metal strip as recited in claim 28 wherein a computer is used to implement the estimator and regulator.

* * * * *